US005404788A

United States Patent [19]

Frix

[11] Patent Number: 5,404,788

[45] Date of Patent: Apr. 11, 1995

[54] MUSICAL INSTRUMENT WITH KEYBOARD

[76] Inventor: Grace J. Frix, 231 Gun Club Rd., Richmond, Va. 23221

[21] Appl. No.: 900,456

[22] Filed: Jun. 18, 1992

[51] Int. Cl.[6] ..... G10C 3/12

[52] U.S. Cl. ..... 84/423 R; 84/424; 84/428; 84/483.2

[58] Field of Search ..... 84/428 R, 447, 448, 84/451, 483.2, 424, 428

[56] References Cited

U.S. PATENT DOCUMENTS

| | | | |
|---|---|---|---|
| 119,335 | 9/1871 | Edgar . | |
| 152,726 | 7/1874 | Cramer . | |
| 334,484 | 1/1886 | Stewart . | |
| 360,255 | 3/1887 | Von Janko . | |
| 1,958,227 | 5/1933 | Barnett | 84/423 |
| 2,406,946 | 9/1946 | Firestone | 84/123 |
| 3,331,271 | 7/1967 | Glenn | 84/478 |
| 3,865,004 | 2/1975 | Coles | 84/423 |
| 3,943,811 | 3/1976 | Coles | 84/423 X |
| 3,986,422 | 10/1976 | Coles | 84/101 |
| 4,054,079 | 10/1977 | Sohler | 84/423 |
| 4,277,090 | 7/1981 | Lusi | 283/47 |
| 4,281,578 | 8/1981 | Tanimoto et al. | 84/470 |
| 4,444,083 | 4/1984 | Apel et al. | 84/423 R |
| 4,640,173 | 2/1987 | Coles | 84/442 X |
| 4,926,734 | 5/1990 | Rickey | 84/423 |

OTHER PUBLICATIONS

*Britannica Book of Music,* Doubleday & Company, Inc., Garden City, New York, 1980, pp. 823–829.

*McGraw-Hill Encyclopedia of Science and Technology,* 5th Edition, McGraw-Hill Book Company, New York, 1982, pp. 826–837.

*Webster's Third New International Dictionary,* G. & C. Merriam Company, Springfield, Massachusetts, 1971, pp. 1724–1725.

*The World Book Encyclopedia,* vol. 13, World Book, Inc., Chicago, Illinois, 1983, pp. 786–798.

*Encyclopedia Britannica,* vol. 16, Encyclopedia Britannica, Inc. Chicago, Illinois, 1944, pp. 3–24.

*Primary Examiner*—William M. Shoop, Jr.
*Assistant Examiner*—Jeffrey W. Dongls
*Attorney, Agent, or Firm*—Donald W. Marks

[57] ABSTRACT

A keyboard for a musical instrument based on a twelve note per octave scale has keys on at least two playing rows, including a front playing row and a rear playing row. The front playing row includes keys for the notes "D♭", "E♭", "F", "G", "A", "B" and the rear playing row includes keys for the notes "G♭", "A♭", "B♭", "C", "D", "E". The keys "F", "G", "A", "B", "C", "D", "E" are formed from a first white smooth material and the keys "D♭", "E♭", "G♭", "A♭", "B♭" are formed from a black rough material which is distinguished both tactually and visually from the white smooth material. There is also disclosed an electronic musical instrument having a plurality of different tuning intonations which are selected either manually or automatically.

7 Claims, 3 Drawing Sheets

MUSICAL INSTRUMENT WITH KEYBOARD

TECHNICAL FIELD

The present invention relates of musical instruments, such as pianos, organs, electronic keyboards, xylophones, and the like, with keyboards or other inputs.

BACKGROUND ART

A conventional diatonic keyboard, such as a piano keyboard, consists of a plurality of sequential side-by-side octaves wherein each octave is formed by twelve keys with seven successive side-by-side white keys in a front row and with five black keys in a back row interspersed between rear portions of alternating groups of three and four white keys. Alternate keyboard arrangements have been proposed, such as that of U.S. Pat. No. 2,406,946 to Firestone and U.S. Pat. No. 152,726 to Cramer.

Firestone's keyboard consists of six white keys and six black keys to the octave, with a black key between rear portions of each pair of adjoining white keys. The black keys are situated above and to the rear of the principal playing surface of the white keys. The front row of keys are for the notes "D♭", "E♭", "F", "G", "A", "B" and the back row of keys are for the notes "G♭", "A♭", "B♭", "C", "D", "E".

Since the conventional keyboard has been used for centuries, it can be difficult for a pianist to switch to an alternate keyboard such as that of Firestone. The Firestone keyboard is visually and tactually confusing to a pianist already indoctrinated with the conventional keyboard. In using the Firestone keyboard the pianist requires an auxiliary reference device for identifying the keys.

Firestone also discloses a notation system including a brace of five staffs wherein the notes written on lines are played on one row of keys and notes written on spaces represent the other row of keys. According to the Firestone notation system, each staff consists of a group of five equal-spaced lines, with the spaces between the lines being equal. The lines of each group are for the notes A♭, B♭, C, D, and E. The spaces of each group are for the notes A, B, D♭, E♭. The note G is printed in the space below the lowest line; the note F is printed in the space just above the highest line. The note G♭ is printed on a semi-line equidistant between groups.

Various tunings, i.e., relative frequencies, of the twelve notes of a conventional twelve note or step per octave scale have been employed in the prior art including those known as Pythagorean intonation, just intonation and equal temperament. Table I sets forth the frequencies in Hertz (Hz) and the cents of a two octave portion of a keyboard beginning with A below middle C in equal, just and Pythagorean intonations tuned on a C scale, i.e., with C as the tonic or base note. Cents is a conventional logarithmic scale according to the equation:

$$\text{CENTS} = \frac{1200}{\text{LOG } 2} \times \text{LOG}\left(\frac{N}{T}\right)$$

wherein T is the fundamental frequency of the first note (in the case of Table I, A or 220 Hz) and N is the fundamental frequency of the second note. The Pythagorean and just intonations are based upon setting selective relative notes, i.e., intervals and chords, to be highly consonant. Consonance is produced by the absence of audible beats and dissonance when two notes are played simultaneously.

The Pythagorean tuning is based upon the successive setting of perfect fifth intervals and octaves between

TABLE I

EQUAL, JUST and PYTHAGOREAN INTONATIONS (Tuned on C scale)

| | Frequency (Hz) | | | Cents | | |
|---|---|---|---|---|---|---|
| NOTE | Equal | Just | Pythagorean | Equal | Just | Pythagorean |
| A | 220 | 220 | 220 | 0 | 0 | 0 |
| B♭ | 233 | 235 | 232 | 100 | 112 | 90 |
| B | 247 | 248 | 248 | 200 | 204 | 204 |
| C | 262 | 264 | 261 | 300 | 316 | 294 |
| C♯ | 277 | 282 | 275 | 400 | 428 | 384 |
| D | 294 | 297 | 293 | 500 | 520 | 498 |
| E♭ | 311 | 317 | 309 | 600 | 632 | 588 |
| E | 330 | 330 | 330 | 700 | 702 | 702 |
| F | 349 | 352 | 348 | 800 | 814 | 792 |
| F♯ | 370 | 371 | 366 | 900 | 906 | 882 |
| G | 392 | 396 | 391 | 1000 | 1018 | 996 |
| A♭' | 415 | 423 | 412 | 1100 | 1130 | 1086 |
| A' | 440 | 440 | 440 | 1200 | 1200 | 1200 |
| B♭' | 466 | 469 | 464 | 1300 | 1312 | 1290 |
| B' | 494 | 495 | 495 | 1400 | 1404 | 1404 |
| C' | 523 | 528 | 521 | 1500 | 1516 | 1494 |
| C♯' | 554 | 563 | 549 | 1600 | 1628 | 1584 |
| D' | 587 | 594 | 587 | 1700 | 1720 | 1698 |
| E♭' | 622 | 634 | 618 | 1800 | 1832 | 1788 |
| E' | 659 | 660 | 660 | 1900 | 1902 | 1902 |
| F' | 699 | 704 | 695 | 2000 | 2014 | 1992 |
| F♯' | 740 | 743 | 732 | 2100 | 2106 | 2082 |
| G' | 784 | 792 | 782 | 2200 | 2218 | 2196 |
| A♭" | 831 | 845 | 424 | 2300 | 2330 | 2286 |
| A" | 880 | 880 | 880 | 2400 | 2400 | 2400 |

keys. In the notes of a perfect fifth interval, the higher note has a fundamental frequency which is exactly 3/2 times the fundamental frequency of the lower tone so that the second harmonic of the higher note is equal to the third harmonic of the lower note to produce consonance. Beginning with the tonic, e.g., middle C in the C scale, two successive upward fifths are tuned followed by downward tuning an octave, e.g., G is tuned relative to C, D' (the prime indicates that the key is in the next higher octave) is tuned relative to G, and D is tuned relative to D'. This procedure is repeated for three more keys, e.g., A-D, E'-A, E-E' and B-E so that now the relative tuning of six keys, e.g., C, D, E, G, A and B is set. Next the base note of the next higher octave, e.g., C'-C, is tuned, and then a downward fifth is tuned, e.g., F-C'. This is followed by an upward octave, e.g., F'-F, and two downward fifths, e.g., B♭-F' and E♭-B♭. The upward octave and downward fifth tuning procedure is continued to complete the tuning of the middle octave, e.g., E♭'-E♭, A♭-E♭', C♯-A♭, C♯'-C♯ and F♯-C♯'. The notes in the remaining higher and lower octaves are tuned from the now tuned octave. The ratios of the fundamental frequencies of the notes in the tuned octave relative to the tonic or base note are shown in Table II for a C scale tuned in accordance with the above Pythagorean tuning procedure.

The just tuning system (also called the pure tuning system) is characterized by changing the major third interval from the Pythagorean ratio of 81/64 to the ratio of 5/4 which minimizes beats and renders the just major third interval substantially more consonant. Just tuning is initiated by tuning of the notes of three consecutive triads, e.g. in the C scale, 'F-A-C, C-E-G, and G-B'-D', and then further octave tuning these notes in upper and lower octaves. The remaining notes are tuned using the previously tuned notes, e.g., C♯ is tuned to a major third

TABLE II

| PYTHAGOREAN & JUST RATIOS (Tuned on C scale) | | |
|---|---|---|
| | RATIO | |
| NOTE | PYTHAGOREAN | JUST |
| C | 1/1 | 1/1 |
| C♯ | 256/243 | 16/15 |
| D | 9/8 | 9/8 |
| E♭ | 32/27 | 6/5 |
| E | 81/64 | 5/4 |
| F | 4/3 | 4/3 |
| F♯ | 1024/729 | 7/5 |
| G | 3/2 | 3/2 |
| A♭ | 128/81 | 8/5 |
| A | 27/16 | 5/3 |
| B♭ | 16/9 | 9/5 |
| B | 143/128 | 15/8 |

below F, B♭ is tuned to a perfect fourth above F, E♭ is tuned to a major third below G, A♭ is tuned to a major third below C′, and F♯ is tuned to a major third above D. Table I lists the fundamental frequencies and cents of two octaves of notes in a C scale tuned in the just system, while Table II lists the relative ratios of the fundamental frequencies in one octave of a C scale tuned in the just system.

It is noted that there are variations in the Pythagorean and just tuning systems. For example in a C scale in the just tuning system, D can be set at a ratio of 10/9, F♯ or G♭ can be set at a ratio of 25/18, and A♭ or G♯ can be set at a ratio of 15/16 relative to C.

The major problem with the above scales is that various intervals and chords are dissonant. The following Table III lists major intervals in cents for Pythagorean and just intonation in the C scale. In just intonation, the fifth, fourth, third and sixth intervals are all consonant with 702, 498, 386 and 884 cents, respectively, when the lower note is C, G or A♭, but for the other lower notes, one or more of the intervals are dissonant. In the Pythagorean tuning system, most of the fifth and fourth intervals are consonant, but the third and sixth intervals are general dissonant even when the lower note or tonic of the interval is C. Because of this dissonance, it is standard practice to adjust or temper the tuning of various notes in the scale so as to minimize beats and dissonance in the various intervals.

The practical solution of the prior art is equal temperament wherein the fundamental frequency of each step or note is made exactly equal to $2^{1/12}$ times its immediate lower note. This equal temperament is employed in many musical instruments in use at the present time. As shown in Table I, each note is exactly 100 cents above its

TABLE III

| MAJOR INTERVALS (Cents) (Tuned on C scale) | | | | | | | | |
|---|---|---|---|---|---|---|---|---|
| MAJOR OR TONIC | FIFTH | | FOURTH | | THIRD | | SIXTH | |
| | JUST INTONATION | | | | | | | |
| C | (G) | 702 | (F) | 498 | (E) | 386 | (A′) | 884 |
| G | (D′) | 702 | (C′) | 498 | (B′) | 386 | (E′) | 884 |
| F | (C′) | 702 | (B♯′) | 498 | (A′) | 386 | (D′) | 906 |
| D | (A′) | 680 | (G) | 498 | (F♯) | 386 | (B′) | 884 |
| B♭ | (F) | 702 | (E♭) | 520 | (D) | 408 | (G) | 906 |
| A | (E) | 702 | (D) | 520 | (C♯) | 428 | (F♯) | 906 |
| E♭ | (B♭′) | 680 | (A♭′) | 498 | (G) | 386 | (C′) | 884 |
| E | (B′) | 702 | (A′) | 498 | (G♯) | 428 | (C♯′) | 926 |
| A♭ | (E♭) | 702 | (D♭) | 498 | (C) | 386 | (F) | 884 |

TABLE III-continued

| MAJOR INTERVALS (Cents) (Tuned on C scale) | | | | | | | | |
|---|---|---|---|---|---|---|---|---|
| MAJOR OR TONIC | FIFTH | | FOURTH | | THIRD | | SIXTH | |
| | JUST INTONATION | | | | | | | |
| B | (F♯) | 702 | (E) | 498 | (D♯) | 428 | (G♯) | 926 |
| D♭ | (A♭′) | 702 | (G♭) | 478 | (F) | 386 | (B♭′) | 884 |
| F♯ | (C♯′) | 722 | (B′) | 498 1 | (A♯′) | 406 | (D♯′) | 926 |
| | PYTHAGOREAN INTONATION | | | | | | | |
| C | (G) | 702 | (F) | 498 | (E) | 408 | (A′) | 906 |
| G | (D′) | 702 | (C′) | 498 | (B′) | 408 | (E′) | 906 |
| F | (C′) | 702 | (B♭′) | 498 | (A′) | 408 | (D′) | 906 |
| D | (A′) | 702 | (G) | 498 | (A♯′) | 384 | (B′) | 906 |
| B♭ | (F) | 702 | (E♭) | 498 | (D) | 408 | (G) | 906 |
| A | (E) | 702 | (D) | 498 | (C♯) | 384 | (F♯) | 882 |
| E♭ | (B′) | 702 | (A′) | 498 | (G♯) | 408 | (C♯′) | 906 |
| A♭ | (E♭) | 702 | (D♭) | 498 | (C) | 408 | (F) | 906 |
| B | (F♯) | 628 | (E) | 498 | (D♯) | 384 | (G♯) | 882 |
| D♭ | (A♭′) | 702 | (G♭) | 498 | (F) | 408 | (B♭′) | 906 |
| F♯ | (C♯′) | 702 | (B′) | 522 | (A♯′) | 408 | (D♯′) | 906 |
| | EQUAL TEMPERAMENT | | | | | | | |
| ALL | 700 | | 500 | | 400 | | 900 | |

immediate lower note. As shown in Table III, all the fifth and fourth intervals are generally consonant since noticeable beating and dissonance doesn't begin to occur until the interval varies more than about 4 cents from a perfect tuned interval at notes in the middle octaves. However, the major third and sixth intervals are dissonant in even temperament to cause triads or chords to be somewhat dissonant since each chord includes both major and minor third intervals along with the dominant or fifth interval.

It is an object of the present invention to provide a musical notation and keyboard arrangement system which is advantageous and conducive to musical education.

It is a further object of the present invention to provide tuning for a musical instrument which is highly consonant for all major intervals and chords.

SUMMARY OF INVENTION

In a first aspect, the invention is summarized in a keyboard for a musical instrument based on a twelve note per octave scale including front and rear playing rows of six keys each wherein the front row includes keys for the notes D♭, E♭, F, G, A, B, the rear row includes keys are for the notes G♭, A♭, B♭, C, D, E, and the keys for the notes F, G, A, B, C, D, E are formed from a material clearly distinguished from a second material of which the keys D♭, E♭, G♭, A♭, B♭ are made. For example the keys F, G, A, B, C, D, E are white while the keys D♭, E♭, G♭, A♭, B♭ are black for visually distinguished the sets of keys, and the surface of the keys D♭, E♭, G♭, A♭, B♭ are rough to tactually distinguish these keys from the other keys F, G, A, B, C, D, E which are smooth.

In a second aspect the present invention provides a musical notation system having a format particularly suitable for the keyboard arrangements of the present invention. The notation system includes both a treble clef and a bass clef joined in a grand staff wherein each clef includes five parallel lines corresponding to back row keys E, F♯, A♭, B♭, and C. These five parallel lines define four equal spaces between adjacent lines and corresponding to the four adjacent front row white keys F, G, A, B. The five parallel lines E, F♯, A♭, B♭, and C are connected and intersected by lines perpendicular thereto for defining measures. C♯ and E♭ are defined by contiguous spaces above and below, respectively, the staffs, while D is defined by the first short line above and below the staffs.

The Greek letter Delta (Δ) with a short crossing horizontal line is provided at the beginning of each staff of the musical notation system to indicate the notation system. The crossing short line of Delta is provided coextensive with the short lines D of the treble and bass clefs particularly indicating the D in the middle octave of the keyboard, i.e. D above middle C.

In a third aspect, the invention is summarized in an electronic musical instrument including a plurality of intonation circuits each for being selectively and exclusively enabled to generate a plurality of frequencies corresponding to fundamental frequencies of tones in a twelve note per octave musical scale wherein the pluralities of frequencies produced by the respective intonation circuits correspond to different tunings of the twelve note per octave musical scale. A selected intonation circuit is enabled either by an operator switch or by a computer monitoring key operation of a keyboard to impart a selected tuning or intonation to musical tone generators responding to operation of the keys for generating musical tones each having a fundamental frequency and a plurality of harmonic frequencies of the fundamental frequency corresponding to the keys and the selected tuning of the musical scale to thus produce consonance of the keys being played.

An advantage of the present invention is the provision of an alternate keyboard arrangement which is easily understood.

A further advantage of the present invention is the provision of an alternate keyboard arrangement which is coordinate with a new musical notation system.

It is also an advantage of the invention that a higher degree of consonance in music being played can be achieved than is heretofore possible.

DESCRIPTION OF THE PREFERRED EMBODIMENTS

Figure 1:
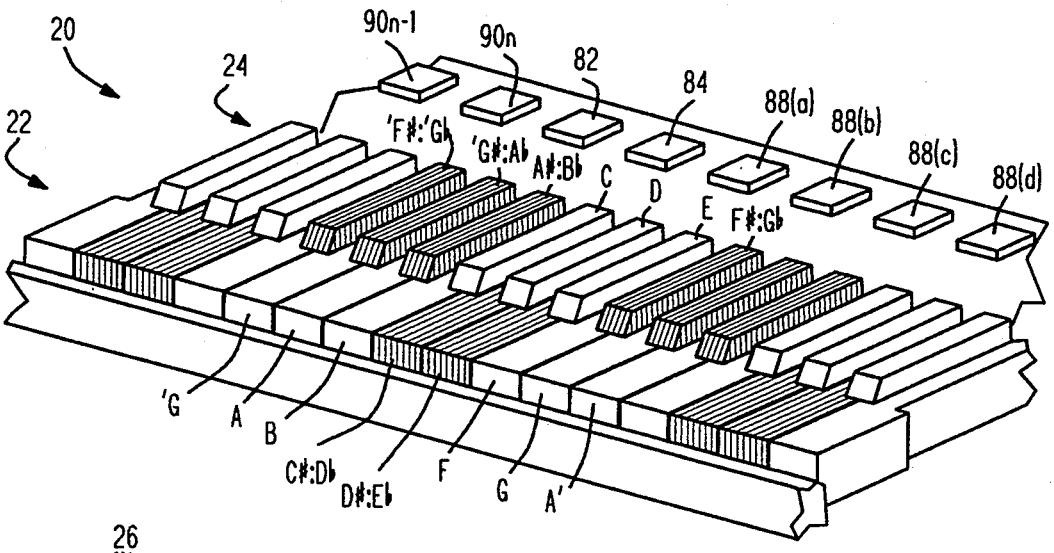
FIG. 1 is an isometric view of a broken-away portion of a two-row keyboard arrangement according to one embodiment of the invention.

As shown in FIG. 1 one embodiment of the invention includes a keyboard arrangement indicated generally at 20 for a musical instrument such as a piano, an organ or an electronic keyboard. FIG. 1 shows a portion of a keyboard 20 having keys on two playing levels or rows, including a front row 22 and a rear row 24. The front row 22 includes keys for the notes C♯ (alias D♭), D♯ (alias E♭), F, G, A, B. The rear playing level 24 includes keys are for the notes C, D, E, F♯ (alias G♭), G♯ (alias A♭), A♯ (alias B♭). As used herein, notes bearing a prime or apostrophe after the note (e.g., A′) refer to notes in an octave above a middle octave from A below middle C to G above middle C; notes bearing a prime or apostrophe before the note (e.g., ′F) refer to notes in an octave below the middle octave.

Figure 2:
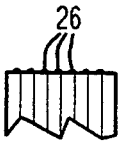
FIG. 2 is an elevation view of a broken away portion of a black key in the keyboard of FIG. 1.

In accordance with one aspect of the invention, the keys F, G, A, B, C, D, E are made from a first material, such as a smooth material of a first color (for example white), and the keys D♭, E♭, G♭, A♭, B♭ are made from a second material such as a rough material with bumps 26 (FIG. 2) of a second color (for example black) so that the second material can be easily distinguished from the first material. The keys have their same coloring (white and black) as provided on conventional keyboards except that the keys are arranged differently. The black and white coloring provides a ready distinguished visual difference between the white keys of the C major diatonic scale (the keys in the front row of a conventional keyboard) and the black keys employed in other diatonic scales (the keys in the back row of a conventional keyboard). Additionally, roughness of the upper surface of the black keys provides a ready tactual distinction between the C major scale keys and the other keys.

Figure 3:
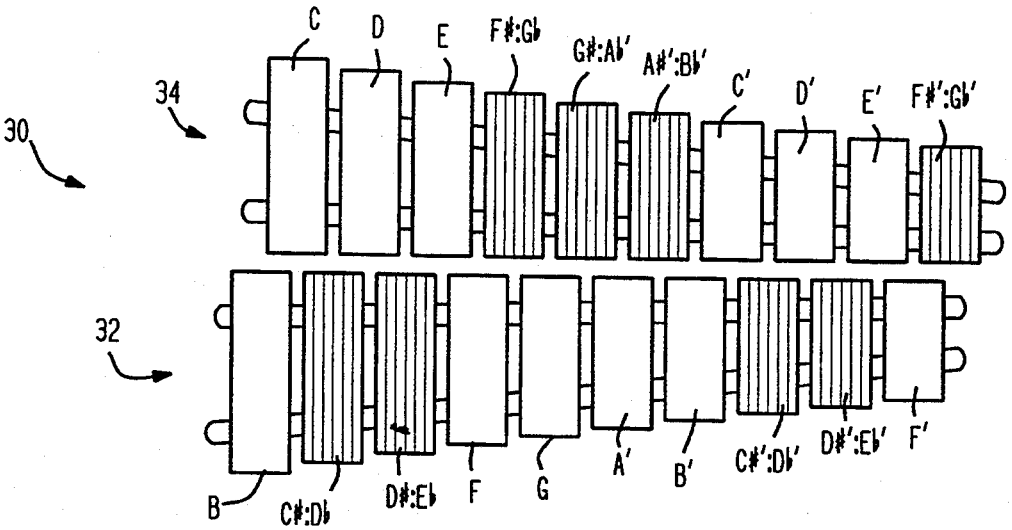
FIG. 3 is a top view of a broken-away portion of a two-row keyboard arrangement according to a second embodiment of the invention.

FIG. 3 shows a keyboard arrangement, indicated generally at 30, according to another embodiment of the invention for an instrument such as an xylophone. The keyboard 30 has keys on two playing rows, including a front playing row 32 and a rear playing row 34. The front playing row 32 includes keys for the notes D♭, E♭, F, G, A, B. The rear playing row 34 includes keys for the notes G♭, A♭, B♭, C, D, E. As with the keyboard 20 of FIG. 1, the keys F, G, A, B, C, D, E have a first color (e.g., white) while keys D♭, E♭, G♭, A♭, B♭ have a second color (e.g., black).

Figure 4:
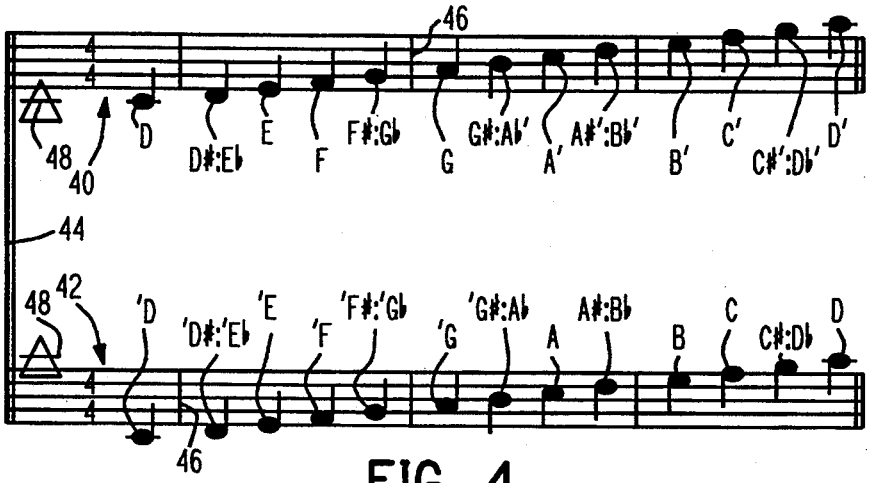
FIG. 4 is a schematic view of a portion of a musical scale showing a Delta music notation system.

FIG. 4 schematically shows a musical notation system having a format particularly suitable for the keyboard arrangements of FIGS. 1 and 3. The notation system includes both a treble clef 40 and a bass clef 42 which are joined by lines 44 into a grand staff. Each clef comprises five parallel lines wherein the lines of the treble clef designate the notes E, F♯, A♭′, B♭′ and C′ above a middle D and the lines of the bass clef designate the notes C, B♭, A♭, ′F♯ and ′C below the middle D. The five parallel lines of the treble clef define four equal spaces designating the notes F, G, A′ and B′ above the middle D while the five parallel lines of the bass clef define four equal spaces designating the notes B, A, ′G and ′F below middle D. The five parallel lines of each clef are connected and intersected by lines (e.g., line 46) perpendicular thereto for defining measures. Respective musical notes D♯:D♭ and ′D♯:′E♭ occupy the spaces beneath the bottommost parallel connected lines E and ′E of the treble and bass clefs. Similarly, respective musical notes C♯′:D♭′ and C♯:D♭ occupy spaces above the topmost parallel connected lines C′ and C of the treble and bass clefs.

Musical notes D, D′ and ′D occupy further short lines provided parallel to but spaced below and above the five parallel lines of the clefs by a further space equal to the spacing of the clef lines. Thus the note D is provided below line E and space E♭ of the treble clef and above the line C and space C♯ of the bass clef; the note D′ is provided above line C′ and space C♯′ of the treble clef; and the note ′D is provided below the line ′E and the space E♭ below the bass clef.

The Greek letter Delta is provided at the beginning of each clef of the musical notation system to indicate the particular musical notation system. The Delta on the treble clef is provided with a crossing line 48 coextensive with the line D below the treble cleft, and the Delta on the bass clef has its crossing line 48 coextensive with the line D above the bass cleft so as to indicate the location of middle D.

Viewing the notation system of FIG. 4 with the keyboard arrangements of FIGS. 1 and 3, it is noted that the four contiguous front row white keys on the right and left sides of middle D are defined by the spaces between the lines of the respective treble and bass clefs. The center rear white key corresponds to the middle D which is in the middle of the grand staff, i.e., below the treble clef and above the bass clef. Further the middle line (G♯:A♭' and 'G♯:A♭) of each clef designates the middle rear black key on the respective side of middle D. The rear white keys on upper and lower sides of the black keys are designated by the uppermost and lowermost clef lines in the corresponding clefs. Also the black front keys on the upper and lower sides of the front white keys are designated by the spaces immediately above and below the corresponding clefs. The symmetry of the music notation system of FIG. 4 combined with the key arrangement of FIGS. 1 and 3 provides a music system that is substantially easier to master compared to the conventional system.

Figure 5:
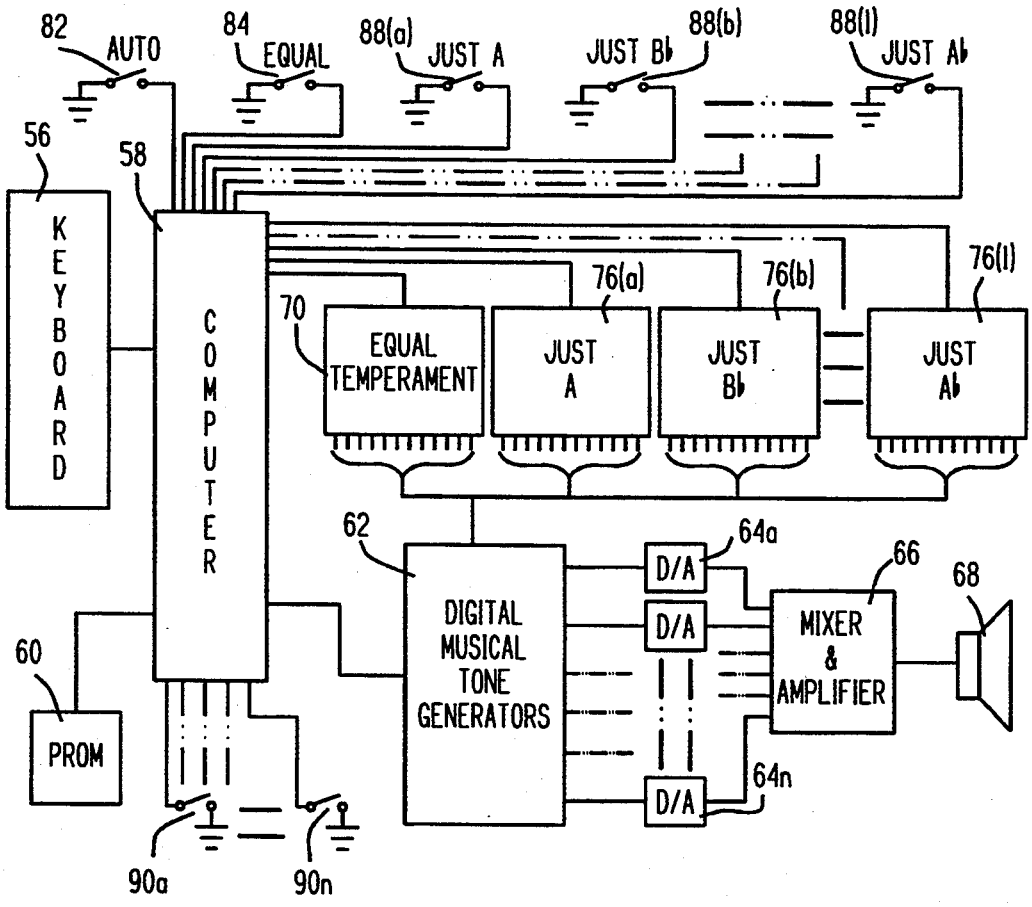
FIG. 5 is an electrical schematic of an electronic musical instrument according to a further embodiment of the invention.

In an electronic musical instrument illustrated in FIG. 5, a keyboard 56 applies signals indicating one or more depressed keys to a computer 58 which downloads corresponding segments of digitized musical tone signals from PROM 60 to one or more selected tone generators of a plurality of digital musical tone generators 62 to produce one or more digital electrical streams of musical notes which are converted to electrical analog signals in respective digital-to-analog (D/A) converters 64*a–n*. The outputs of the converters 64*a–n* are combined in a mixer and amplifier circuit 66 which drives a speaker system 68 to broadcast the music played by the musician on the keyboard 56. The electronic musical instrument also includes a plurality of intonation circuits such as equal temperament circuit 70 and twelve just intonation circuits 76(*a–l*) tuned on the respective scales A, B♭, . . . , A♭ which determine the intonation or tuning of the notes produced by the tone generators 62 and DA converters 64*a–n*. The following tables IV, V and VI list the cents and fundamental frequencies of the notes in a middle octave produced by the tone generators for tuning in each of twelve just intonation scales. While the listed tuning cents and frequencies based on the just ratios of Table II are preferred, it is noted that the cents and frequencies, particularly of the more dissonant notes or intervals, can vary. For example the ratio of the major second (D in Table II) is sometimes set at 10/9, the ratio of the diminished fifth (F♯ in Table II) is sometimes set at 25/18, and the ratio of the augmented fifth (A♭ in Table II) is sometimes set at 15/16. The computer 58 also has inputs from a plurality of switches 82, 84, and 88(*a–l*) which the musician uses to select a desired intonation. Computer outputs to the intonation circuits 70, 76(*a–l*) and the tone generators 62 selectively enable the intonation circuits and control the tone generators. Inputs to the computer 58 from a plurality of switches 90*a*, . . . , 90*n* select a particular voice or instrument to be played by the electronic instrument.

The keyboard 56 is a conventional keyboard used in electronic musical instruments with a conventional key arrangement of seven front row white keys and five back row black keys in each octave, or alternatively the keyboard 56 employs the key arrangement of the keyboard 20 of FIG. 1.

TABLE IV

| | JUST INTONATIONS | | | | | | | |
|---|---|---|---|---|---|---|---|---|
| | TUNED ON A | | TUNED ON B♭ | | TUNED ON B | | TUNED ON C | |
| NOTE | Cents | Hz | Cents | Hz | Cents | Hz | Cents | Hz |
| A | 0 | 220 | 0 | 220 | 0 | 220 | 0 | 220 |
| B♭ | 112 | 235 | 112 | 235 | 92 | 232 | 112 | 235 |
| B | 204 | 248 | 224 | 250 | 204 | 248 | 204 | 248 |
| C | 316 | 264 | 316 | 264 | 316 | 264 | 316 | 264 |
| C♯ | 386 | 275 | 428 | 282 | 408 | 278 | 428 | 282 |
| D | 498 | 293 | 498 | 293 | 520 | 297 | 520 | 297 |
| E♭ | 590 | 309 | 610 | 313 | 590 | 309 | 632 | 317 |
| E | 702 | 330 | 702 | 330 | 702 | 330 | 702 | 330 |
| F | 814 | 352 | 814 | 352 | 794 | 348 | 814 | 352 |
| F♯ | 884 | 367 | 926 | 376 | 906 | 371 | 906 | 371 |
| G | 996 | 391 | 996 | 391 | 1018 | 396 | 1018 | 396 |
| A♭' | 1088 | 412 | 1108 | 417 | 1088 | 412 | 1130 | 423 |
| A' | 1200 | 440 | 1200 | 440 | 1200 | 440 | 1200 | 440 |

TABLE V

| | JUST INTONATIONS | | | | | | | |
|---|---|---|---|---|---|---|---|---|
| | TUNED ON C♯ | | TUNED ON D | | TUNED ON E♭ | | TUNED ON E | |
| NOTE | Cents | Hz | Cents | Hz | Cents | Hz | Cents | Hz |
| A | 0 | 220 | 0 | 220 | 0 | 220 | 0 | 220 |
| B♭ | 70 | 229 | 112 | 235 | 92 | 232 | 92 | 232 |
| B | 182 | 244 | 182 | 244 | 204 | 248 | 204 | 248 |
| C | 274 | 258 | 294 | 261 | 274 | 258 | 316 | 264 |
| C♯ | 386 | 275 | 386 | 275 | 386 | 275 | 386 | 275 |
| D | 498 | 293 | 498 | 293 | 478 | 290 | 498 | 293 |
| E♭ | 590 | 309 | 610 | 313 | 590 | 309 | 590 | 309 |
| E | 702 | 330 | 702 | 330 | 702 | 330 | 702 | 330 |
| F | 772 | 344 | 814 | 352 | 794 | 348 | 814 | 352 |
| F♯ | 884 | 367 | 884 | 367 | 906 | 371 | 906 | 371 |
| G | 976 | 387 | 996 | 391 | 976 | 387 | 1018 | 396 |
| A♭' | 1088 | 412 | 1088 | 412 | 1088 | 412 | 1088 | 412 |

TABLE V-continued

| | JUST INTONATIONS | | | | | | | |
|---|---|---|---|---|---|---|---|---|
| | TUNED ON C# | | TUNED ON D | | TUNED ON E♭ | | TUNED ON E | |
| NOTE | Cents | Hz | Cents | Hz | Cents | Hz | Cents | Hz |
| A' | 1200 | 440 | 1200 | 440 | 1200 | 440 | 1200 | 440 |

TABLE VI

| | JUST INTONATIONS | | | | | | | |
|---|---|---|---|---|---|---|---|---|
| | TUNED ON F | | TUNED ON F# | | TUNED ON G | | TUNED ON A♭ | |
| NOTE | Cents | Hz | Cents | Hz | Cents | Hz | Cents | Hz |
| A | 0 | 220 | 0 | 220 | 0 | 220 | 0 | 220 |
| B♭ | 112 | 235 | 70 | 229 | 112 | 235 | 92 | 232 |
| B | 204 | 248 | 182 | 244 | 182 | 244 | 204 | 248 |
| C | 316 | 264 | 274 | 258 | 294 | 261 | 274 | 258 |
| # | 428 | 282 | 386 | 275 | 386 | 275 | 386 | 275 |
| D | 498 | 293 | 498 | 293 | 498 | 293 | 478 | 290 |
| E♭ | 610 | 313 | 568 | 305 | 610 | 313 | 590 | 309 |
| E | 702 | 330 | 680 | 326 | 680 | 326 | 702 | 330 |
| F | 814 | 352 | 772 | 344 | 792 | 348 | 772 | 344 |
| F# | 926 | 376 | 884 | 367 | 884 | 367 | 884 | 367 |
| G | 1018 | 396 | 996 | 391 | 996 | 391 | 976 | 387 |
| A♭' | 1130 | 423 | 1088 | 412 | 1108 | 417 | 1088 | 412 |
| A' | 1200 | 440 | 1200 | 440 | 1200 | 440 | 1200 | 440 |

In any event, the keyboard 56 includes the additional tuning selection switches 82, 84, 86(*a*), 86(*b*) and 88(*a–l*) along with the conventional voice selecting switches 90*a–n*. Furthermore the keyboard could be a computer or any other device generating signals corresponding to notes. The note signals to the computer 58 can be serial or parallel and can be in accordance with the Musical Instrument Digital Interface (MIDI) or any other protocol or coding scheme.

The intonation circuits 70 and 76(*a–l*) are conventional clock and gating circuits each generating, when enabled, twelve clock signals which are multiples of the corresponding notes E to E♭'. For example in the just C scale, the lowest clock signal corresponding to E is about 42,240 Hz while the highest clock signal corresponding to E♭ is about 81,100 Hz. The clock signals from the different circuits 70 and 76(*a–l*) contain many repetitions as can be seen from Tables IV, V and VI so that many clock or divider outputs are shared and connected to gate inputs of two or more of the intonations circuits.

Figure 6:
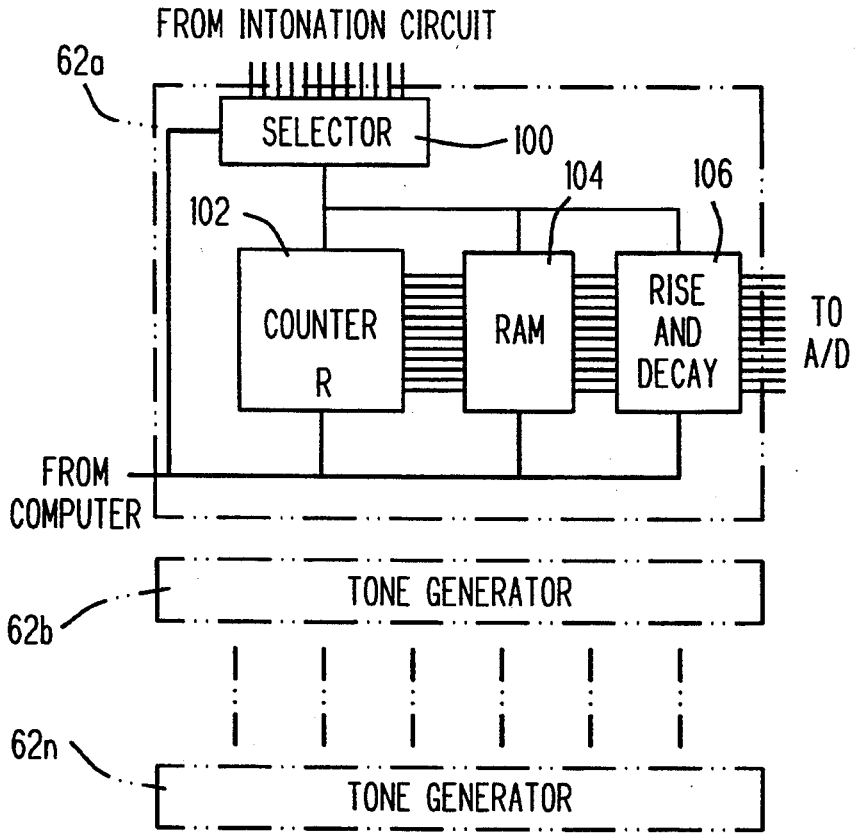
FIG. 6 is an electrical schematic of tone generators employed in the electronic musical instrument of FIG. 5.

As shown in FIG. 6, the clock signals from the enabled intonation circuit of FIG. 5 are applied to a selector 100 which is operated by the computer 58 of FIG. 5 to select one of the clock signals from the enabled intonation circuit for the counter 102, RAM 104 and rise and decay circuit 106 in each of the tone generators 62*a*, 62*b*, . . . , 62*n* that may be operated by the computer 58 to play a note. The computer 58 in response to the receipt of a note signal from the keyboard 56 downloads, for example by direct memory transfer, the data segment from the PROM 60 which corresponds to both the octave of the depressed key and the voice or instrument selected by one of the switches 90*a*, . . . 90*n* to the RAM 104. Additionally corresponding data regarding the rise and decay time of the note and the selected voice are transferred from the PROM 60 to the rise and decay circuit 106. The counter 102 sequentially addresses the RAM 104 to sequentially read out the digital note data with the counter continuously cycling at least a portion of the RAM. The rise and decay circuit 106 adjusts the amplitude of the digital signals in the digital stream to produce the corresponding rise and decay times. Alternatively, rise and decay information and/or initial percussive sound may be inherent in one or more data segments transferred to the RAM 104 from the PROM 60. In any event the particular tuning or fundamental frequency of the note being played within the selected octave is determined by the clock signal selected by selector 100 from the enabled intonation circuit of circuits 70 and 76(*a–l*).

Figure 7:
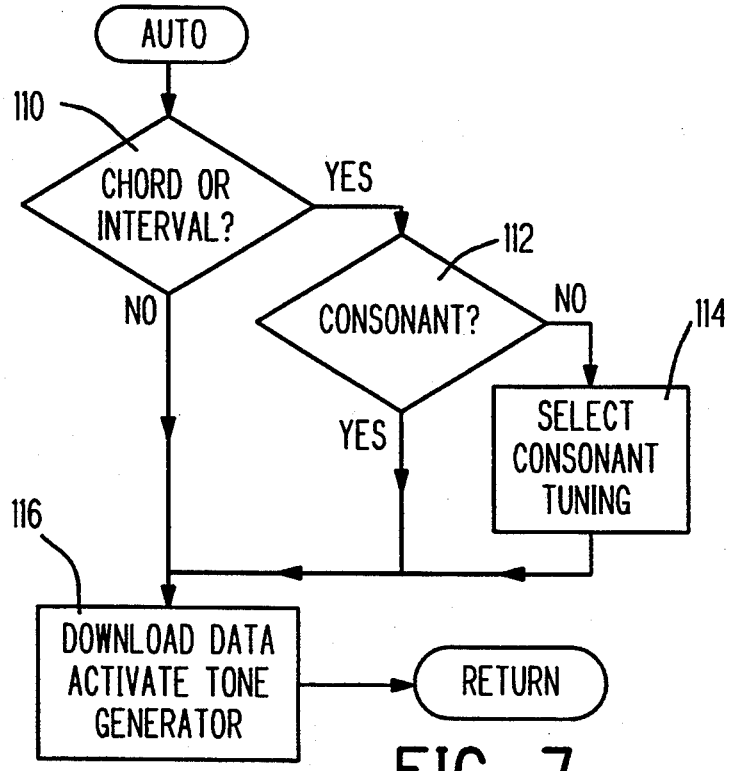
FIG. 7 is a step diagram of an program procedure employed in a computer of the instrument of FIG. 5.

The computer 58 periodically monitors the switches 82, 84, 88(*a–l*) and 90*a–n*. The tuning switch 82 calls for automatic selection of one of the just intonation circuits 76(*a–l*) based upon the detection of an interval or chord being played on the keyboard 56 as shown in the computer program procedure of FIG. 7. In step 110, it is determined if two or more notes are simultaneously being played and if these notes form a chord or interval which is supposed to be consonant. When step 110 is true, the program proceeds to step 112 where it is determined if the interval or chord is consonant in the scale of the enabled intonation circuit 76(*a–l*). If not, then in step 114 the computer 58 disables the enabled intonation circuit and enables another intonation circuit in which the interval or chord is consonant. Then in step 116, the data from the PROM 60 is transferred to the corresponding tone generator 62*a–n* and this tone generator is activated.

It is noted that the digitized note data recorded in the PROM 60 is rich in harmonics which results in the consonance or melodic interplay of the notes in the interval or chord. For example when the fifth interval is consonant, the second harmonic of the higher note is equal to the third harmonic of the lower note; when the fourth interval is consonant, the third harmonic of the higher note is equal to the fourth harmonic of the lower note; when the major third interval is consonant, the fourth harmonic of the higher note is equal to the fifth harmonic of the lower note; when the major sixth interval is consonant, the third harmonic of the higher note is equal to the fifth harmonic of the lower note; and when the minor third interval is consonant, the fifth harmonic of the higher note is equal to the sixth harmonic of the lower note. A major chord or triad is formed by a fifth interval plus a major third interval while a minor chord or triad includes a minor third interval with a fifth interval.

The following Tables VII through XVIII list the fifth, fourth, major third, sixth and minor third intervals in cents for each of the intonation circuits 76(*a–l*).

To determine whether an interval or chord is consonant in step 112, the tables VII through XVIII can be stored in the PROM 60 and the interval can be looked up in the tables. The fifth interval is consonant when equal to 702 cents; the fourth interval is consonant when equal to 498 cents; the major third interval is consonant when equal to 386 cents; the sixth interval is consonant when equal to 884 cents; and the minor third interval is consonant when equal to 316 cents; It is noted that all the intervals, fifth, fourth, major third, sixth and minor third, are simultaneously consonant only for the scale of the tonic or base note. Thus when a dissonant interval or chord is uncovered, the interval or chord is readily rendered consonant by selecting the tuning scale of the tonic or base note of the interval in step 114. When the notes being played include two or more intervals and/or chords which have different base notes, the second interval or chord may not be consonant in the tuning scale of the first interval or chord. In this instance the program in step

TABLE VII

| MAJOR OR TONIC | INTERVALS (Cents) (Just tuned on A scale) FIFTH | FOURTH | MAJOR THIRD | SIXTH | MINOR THIRD |
|---|---|---|---|---|---|
| C | 680 | 498 | 386 | 884 | 274 |
| G | 702 | 520 | 408 | 906 | 316 |
| F | 702 | 498 | 386 | 884 | 274 |
| D | 702 | 498 | 386 | 906 | 316 |
| B♭ | 702 | 478 | 386 | 884 | 274 |
| A | 702 | 498 | 386 | 884 | 316 |
| E♭ | 722 | 498 | 406 | 926 | 294 |
| E | 702 | 498 | 386 | 884 | 294 |
| A♭ | 702 | 498 | 428 | 926 | 316 |
| B | 680 | 498 | 386 | 884 | 294 |
| C♯ | 702 | 498 | 428 | 926 | 316 |
| F♯ | 702 | 520 | 428 | 906 | 316 |

TABLE VIII

| MAJOR OR TONIC | INTERVALS (Cents) (Just tuned on B♭ scale) FIFTH | FOURTH | MAJOR THIRD | SIXTH | MINOR THIRD |
|---|---|---|---|---|---|
| C | 680 | 498 | 386 | 884 | 294 |
| G | 702 | 520 | 428 | 906 | 316 |
| F | 702 | 498 | 386 | 884 | 294 |
| D | 702 | 498 | 428 | 926 | 316 |
| B♭ | 702 | 478 | 386 | 884 | 316 |
| A | 702 | 498 | 428 | 926 | 316 |
| E♭ | 702 | 498 | 386 | 906 | 316 |
| E | 722 | 498 | 406 | 926 | 294 |
| A♭ | 702 | 520 | 408 | 906 | 316 |
| B | 702 | 478 | 386 | 884 | 274 |
| C♯ | 680 | 498 | 386 | 884 | 274 |
| F♯ | 702 | 498 | 386 | 884 | 274 |

TABLE IX

| MAJOR OR TONIC | INTERVALS (Cents) (Just tuned on B scale) FIFTH | FOURTH | MAJOR THIRD | SIXTH | MINOR THIRD |
|---|---|---|---|---|---|
| C | 702 | 478 | 386 | 884 | 274 |

TABLE IX-continued

| MAJOR OR TONIC | INTERVALS (Cents) (Just tuned on B scale) FIFTH | FOURTH | MAJOR THIRD | SIXTH | MINOR THIRD |
|---|---|---|---|---|---|
| G | 702 | 498 | 386 | 884 | 274 |
| F | 722 | 498 | 406 | 926 | 294 |
| D | 680 | 498 | 386 | 884 | 274 |
| B♭ | 702 | 498 | 428 | 926 | 316 |
| A | 702 | 520 | 408 | 906 | 316 |
| E♭ | 702 | 498 | 428 | 926 | 316 |
| E | 702 | 498 | 386 | 906 | 316 |
| A♭ | 702 | 520 | 428 | 906 | 316 |
| B | 702 | 498 | 386 | 884 | 316 |
| C♯ | 680 | 498 | 386 | 884 | 294 |
| F♯ | 702 | 498 | 386 | 884 | 294 |

TABLE X

| MAJOR OR TONIC | INTERVALS (Cents) (Just tuned on C scale) FIFTH | FOURTH | MAJOR THIRD | SIXTH | MINOR THIRD |
|---|---|---|---|---|---|
| C | 702 | 498 | 386 | 884 | 316 |
| G | 702 | 498 | 386 | 884 | 294 |
| F | 702 | 498 | 386 | 906 | 316 |
| D | 680 | 498 | 386 | 884 | 294 |
| B♭ | 702 | 520 | 408 | 906 | 316 |
| A | 702 | 520 | 428 | 906 | 316 |
| E♭ | 680 | 498 | 386 | 884 | 274 |
| E | 702 | 498 | 428 | 926 | 316 |
| A♭ | 702 | 498 | 386 | 884 | 274 |
| B | 702 | 498 | 428 | 926 | 316 |
| C♯ | 702 | 478 | 386 | 884 | 274 |
| F♯ | 722 | 498 | 406 | 926 | 294 |

TABLE XI

| MAJOR OR TONIC | INTERVALS (Cents) (Just tuned on C♯ scale) FIFTH | FOURTH | MAJOR THIRD | SIXTH | MINOR THIRD |
|---|---|---|---|---|---|
| C | 702 | 498 | 428 | 926 | 316 |
| G | 722 | 498 | 406 | 926 | 294 |
| F | 702 | 498 | 428 | 926 | 316 |
| D | 702 | 478 | 386 | 884 | 274 |
| B♭ | 702 | 520 | 428 | 906 | 316 |
| A | 702 | 498 | 386 | 884 | 274 |
| E♭ | 680 | 498 | 386 | 884 | 294 |
| E | 680 | 498 | 386 | 884 | 274 |
| A♭ | 702 | 498 | 386 | 884 | 294 |
| B | 702 | 520 | 408 | 906 | 316 |
| C♯ | 702 | 498 | 386 | 884 | 316 |
| F♯ | 702 | 498 | 386 | 906 | 316 |

TABLE XII

| MAJOR OR TONIC | INTERVALS (Cents) (Just tuned on D scale) FIFTH | FOURTH | MAJOR THIRD | SIXTH | MINOR THIRD |
|---|---|---|---|---|---|
| C | 702 | 520 | 408 | 906 | 316 |
| G | 702 | 498 | 386 | 906 | 316 |
| F | 680 | 498 | 386 | 884 | 274 |
| D | 702 | 498 | 386 | 884 | 316 |
| B♭ | 702 | 498 | 386 | 884 | 274 |
| A | 702 | 498 | 386 | 884 | 294 |
| E♭ | 702 | 478 | 386 | 884 | 274 |
| E | 680 | 498 | 386 | 884 | 294 |

TABLE XII-continued

| MAJOR OR TONIC | INTERVALS (Cents) (Just tuned on D scale) FIFTH | FOURTH | MAJOR THIRD | SIXTH | MINOR THIRD |
|---|---|---|---|---|---|
| A♭ | 722 | 498 | 406 | 926 | 294 |
| B | 702 | 520 | 428 | 906 | 316 |
| C♯ | 702 | 498 | 428 | 926 | 316 |
| F♯ | 702 | 498 | 428 | 926 | 316 |

TABLE XIII

| MAJOR OR TONIC | INTERVALS (Cents) (Just tuned on E♭ scale) FIFTH | FOURTH | MAJOR THIRD | SIXTH | MINOR THIRD |
|---|---|---|---|---|---|
| C | 702 | 520 | 428 | 926 | 316 |
| G | 702 | 498 | 428 | 926 | 316 |
| F | 680 | 498 | 406 | 884 | 294 |
| D | 722 | 498 | 428 | 926 | 316 |
| B♭ | 702 | 498 | 386 | 884 | 294 |
| A | 702 | 478 | 386 | 906 | 274 |
| E♭ | 702 | 498 | 386 | 884 | 316 |
| E | 702 | 498 | 386 | 884 | 274 |
| A♭ | 702 | 498 | 386 | 906 | 316 |
| B | 702 | 498 | 386 | 884 | 274 |
| C♯ | 702 | 520 | 408 | 906 | 316 |
| F♯ | 680 | 498 | 386 | 884 | 294 |

TABLE XIV

| MAJOR OR TONIC | INTERVALS (Cents) (Just tuned on E scale) FIFTH | FOURTH | MAJOR THIRD | SIXTH | MINOR THIRD |
|---|---|---|---|---|---|
| C | 702 | 498 | 386 | 884 | 274 |
| G | 680 | 498 | 386 | 884 | 274 |
| F | 702 | 478 | 386 | 884 | 274 |
| D | 702 | 520 | 408 | 906 | 316 |
| B♭ | 722 | 498 | 406 | 926 | 294 |
| A | 702 | 498 | 286 | 906 | 316 |
| E♭ | 702 | 498 | 428 | 926 | 316 |
| E | 702 | 498 | 386 | 884 | 316 |
| A♭ | 702 | 498 | 428 | 926 | 316 |
| B | 702 | 498 | 386 | 884 | 294 |
| C♯ | 702 | 520 | 428 | 906 | 316 |
| F♯ | 680 | 498 | 386 | 884 | 294 |

TABLE XV

| MAJOR OR TONIC | INTERVALS (Cents) (Just tuned on F scale) FIFTH | FOURTH | MAJOR THIRD | SIXTH | MINOR THIRD |
|---|---|---|---|---|---|
| C | 702 | 498 | 386 | 884 | 294 |
| G | 680 | 498 | 386 | 884 | 294 |
| F | 702 | 498 | 386 | 884 | 316 |
| D | 702 | 520 | 428 | 906 | 316 |
| B♭ | 702 | 498 | 386 | 906 | 316 |
| A | 702 | 498 | 428 | 926 | 316 |
| E♭ | 702 | 520 | 408 | 906 | 316 |
| E | 702 | 498 | 428 | 926 | 316 |
| A♭ | 680 | 498 | 386 | 884 | 274 |
| B | 722 | 498 | 406 | 926 | 294 |
| C♯ | 702 | 498 | 386 | 884 | 274 |
| F♯ | 702 | 478 | 386 | 884 | 274 |

TABLE XVI

| MAJOR OR TONIC | INTERVALS (Cents) (Just tuned on F♯ scale) FIFTH | FOURTH | MAJOR THIRD | SIXTH | MINOR THIRD |
|---|---|---|---|---|---|
| C | 722 | 498 | 406 | 926 | 294 |
| G | 702 | 478 | 386 | 884 | 274 |
| F | 702 | 498 | 428 | 926 | 316 |
| D | 702 | 498 | 386 | 884 | 274 |
| B♭ | 702 | 498 | 428 | 926 | 316 |
| A | 680 | 498 | 386 | 884 | 274 |
| E♭ | 702 | 520 | 428 | 906 | 316 |
| E | 702 | 520 | 408 | 906 | 316 |
| A♭ | 680 | 498 | 386 | 884 | 294 |
| B | 702 | 498 | 386 | 906 | 316 |
| C♯ | 702 | 498 | 386 | 884 | 294 |
| F♯ | 702 | 498 | 386 | 884 | 316 |

TABLE XVII

| MAJOR OR TONIC | INTERVALS (Cents) (Just tuned on G scale) FIFTH | FOURTH | MAJOR THIRD | SIXTH | MINOR THIRD |
|---|---|---|---|---|---|
| C | 702 | 498 | 386 | 906 | 316 |
| G | 702 | 498 | 386 | 884 | 316 |
| F | 702 | 520 | 408 | 906 | 316 |
| D | 702 | 498 | 386 | 884 | 294 |
| B♭ | 680 | 498 | 386 | 884 | 274 |
| A | 680 | 498 | 386 | 884 | 294 |
| E♭ | 702 | 498 | 386 | 884 | 274 |
| E | 702 | 520 | 428 | 906 | 316 |
| A♭ | 702 | 478 | 386 | 884 | 274 |
| B | 702 | 498 | 428 | 926 | 316 |
| C♯ | 722 | 498 | 406 | 926 | 294 |
| F♯ | 702 | 498 | 428 | 926 | 316 |

TABLE XVIII

| MAJOR OR TONIC | INTERVALS (Cents) (Just tuned on A♭ scale) FIFTH | FOURTH | MAJOR THIRD | SIXTH | MINOR THIRD |
|---|---|---|---|---|---|
| C | 702 | 498 | 428 | 926 | 316 |
| G | 702 | 498 | 428 | 926 | 316 |
| F | 702 | 520 | 428 | 906 | 316 |
| D | 722 | 498 | 406 | 926 | 294 |
| B♭ | 680 | 498 | 386 | 884 | 294 |
| A | 702 | 478 | 386 | 884 | 274 |
| E♭ | 702 | 498 | 386 | 884 | 294 |
| E | 702 | 498 | 386 | 884 | 274 |
| A♭ | 702 | 498 | 386 | 884 | 316 |
| B | 680 | 498 | 386 | 884 | 274 |
| C♯ | 702 | 498 | 386 | 906 | 316 |
| F♯ | 702 | 520 | 408 | 906 | 316 |

114 can examine the tables VII through XVIII sequentially until a tuning scale is found where both or all of the intervals or chords are consonant. Alternatively, a mathematical algorithm can be composed and utilized since the consonance and dissonance of the intervals in the tables exhibit patterns.

When depressed, the switch 84 causes the computer to select equal temperament tuning of the instrument. The switches 88(*a–l*) correspond to the different just intonation circuits 70(*a–l*) and can be selectively operated to select a particular tuning of the electronic instrument when the music being played is limited to intervals and chords which are consonant in the selected tuning scale or when a particular dissonance is desired for color or other effect in the music.

The provision of the capability to select different tunings in an electronic instrument, either manually or automatically, enables music composition and production with substantially greater harmony or consonance than has heretofore been possible.

While the invention has been particularly shown and described with reference to the preferred embodiments thereof, it will be understood by those skilled in the art that various alterations in form and detail may be made therein without departing from the spirit and scope of the invention.

What is claimed is

1. A system for teaching the playing of music including a keyboard for a musical instrument based on a twelve note per octave scale having keys on at least two playing rows, including a front playing row and a rear playing row, wherein the front playing row includes keys for the notes "D♭", "E♭", "F", "G", "A", "B" and the rear playing row includes keys for the notes "G♭", "A♭", "B♭", "C", "D", "E", and wherein the keys "F", "G", "A", "B", "C", "D", "E" are formed from a first material and the keys "D♭", "E♭", "G♭", "A♭", "B♭" are formed from a second material which is clearly distinguished from the first material; and further comprising: a musical score having a staff formed from five parallel horizontal lines corresponding to the rear keyboard keys "E", "G♭", "A♭", "B♭", and "C", respectively, beginning with the bottommost connected parallel line to the topmost parallel line, said five parallel lines defining four equal spaces between adjacent lines and corresponding to the front keyboard keys "F", "G", "A", "B", respectively beginning with the bottommost space to the topmost space, the five parallel lines being connected and intersected by lines perpendicular thereto for defining measures; with the front keyboard key "E♭" corresponding to a space beneath the bottommost parallel connected line; with the rear keyboard key "D" corresponding to a further line D provided parallel to but separated from the five parallel lines by a further space of equal size of the spaces defined by the five connected lines, but the line D being unconnected to the five parallel connected lines; and, with the front keyboard key "C#" corresponding to a space above the topmost parallel connected line.

2. The system of claim 1, wherein the first material is white and the second material is black so that the second material can be visually distinguished from the first material.

3. The system of claim 1, wherein the first material is smooth and the second material is rough so that the second material can be tactually distinguished from the first material.

4. The system of claim 2, wherein the first material is smooth and the second material is rough so that the second material can be tactually distinguished from the first material.

5. The system of claim 1, wherein a symbol indicative of the system is provided on the line D associated with the musical note D above middle C.

6. The system of claim 5, wherein the symbol is the Greek letter Delta.

7. The system of claim 1 wherein the musical score has treble and bass clefs each formed from said five-line staff but with the line D of the treble clef being below the staff and with the line D of the bass clef being above the staff.

* * * * *